US007507699B2

(12) United States Patent
Burt et al.

(10) Patent No.: US 7,507,699 B2
(45) Date of Patent: Mar. 24, 2009

(54) WATER SOLUBLE CONTAINER CONTAINING DRY ACTIVES COMPRISING A CATIONIC GERMICIDE AND COATED CITRIC ACID

(75) Inventors: Diane Joyce Burt, Montvale, NJ (US); James Chi-Cheng Feng, Montvale, NJ (US); Ralph Gencarelli, Montvale, NJ (US); Jeanne Marie Lesica, Montvale, NJ (US)

(73) Assignee: Reckitt Benckiser Inc., Parsippany, NJ (US)

( * ) Notice: Subject to any disclaimer, the term of this patent is extended or adjusted under 35 U.S.C. 154(b) by 0 days.

(21) Appl. No.: 10/499,405

(22) PCT Filed: Oct. 10, 2002

(86) PCT No.: PCT/GB02/04614

§ 371 (c)(1), (2), (4) Date: Jan. 26, 2005

(87) PCT Pub. No.: WO03/054124

PCT Pub. Date: Jul. 3, 2003

(65) Prior Publication Data

US 2005/0119153 A1 Jun. 2, 2005

(30) Foreign Application Priority Data

Dec. 20, 2001 (GB) ..... 0130419.5

(51) Int. Cl.
*C11D 1/835* (2006.01)
*C11D 3/48* (2006.01)
*C11D 7/12* (2006.01)

(52) U.S. Cl. ..... 510/296; 510/117; 510/235; 510/238; 510/252; 510/362; 510/382; 510/384; 510/421; 510/439; 510/441; 510/443; 510/477; 510/478; 510/504; 510/509

(58) Field of Classification Search ..... 510/117, 510/235, 238, 252, 362, 382, 384, 421, 439, 510/441, 443, 477, 478, 504, 509, 296
See application file for complete search history.

(56) References Cited

U.S. PATENT DOCUMENTS

| | | | | |
|---|---|---|---|---|
| 2,742,434 | A | 4/1956 | Kopp | 252/106 |
| 4,522,738 | A * | 6/1985 | Magid et al. | 510/100 |
| 4,795,032 | A * | 1/1989 | Kandathil | 8/137 |
| 4,844,828 | A | 7/1989 | Aoki | 252/174 |
| 5,534,178 | A * | 7/1996 | Bailly et al. | 510/367 |
| 5,665,742 | A * | 9/1997 | Mori et al. | 514/358 |
| 5,780,418 | A * | 7/1998 | Niinaka et al. | 510/439 |
| 5,783,537 | A * | 7/1998 | Ahmed et al. | 510/193 |
| 5,958,334 | A * | 9/1999 | Haddon | 422/5 |
| 6,239,092 | B1 | 5/2001 | Papasso et al. | 510/238 |
| 6,903,059 | B2 * | 6/2005 | Price et al. | 510/311 |
| 7,056,877 | B2 * | 6/2006 | Caswell et al. | 510/439 |

FOREIGN PATENT DOCUMENTS

| | | |
|---|---|---|
| EP | 0110 588 | 6/1984 |
| GB | 663 565 | 11/1948 |
| GB | 718 050 | 2/1952 |
| GB | 2 348 885 | 10/2000 |
| WO | WO 97/33957 | 9/1997 |
| WO | WO 00/02980 | 1/2000 |
| WO | WO 00/17303 | 3/2000 |

OTHER PUBLICATIONS

International Search Report for PCT/GB02/04614 Feb. 3, 2003.
Search report for GB 0130419.5 Jul. 3, 2002.
Derwent Abstract No. 2000-033795 [03] relating to JP110302694 dated Nov. 2, 1999.

* cited by examiner

*Primary Examiner*—Charles I Boyer
(74) *Attorney, Agent, or Firm*—Norris McLaughlin & Marcus PA

(57) ABSTRACT

The invention relates to a water soluble container which contains a composition useful for hard surface cleaning. The composition comprises a cationic surfactant having germicidal properties, a non-ionic surfactant, an alkali salt, an organic acid; and optionally, conventional additives, where the composition is in powder form. The water soluble containers can be made by thermoforming or injection molding.

22 Claims, No Drawings

WATER SOLUBLE CONTAINER CONTAINING DRY ACTIVES COMPRISING A CATIONIC GERMICIDE AND COATED CITRIC ACID

This is an application filed under 35 U.S.C. 371 of PCT/GB2002/04614.

BACKGROUND OF THE INVENTION

Powder detergent compositions comprising surfactants are known. Such compositions can be used, for example, as hard surface cleaners as well as laundry and automatic dishwasher cleaners. They can be used by placing an amount of powder into a volume of water and then using the resulting solution to clean the surface of interest. In the case of laundry cleaners, a measured amount of the powder is placed into a suitable washing machine. For automatic dishwashers, measured amount of powder is placed in the dishwasher, usually in dispensing cups. For difficult stains, a paste can be made with the powder and small amount of water and then rubbed on the surface. This is true for fabric as well as dish surfaces.

For some purposes it is desirable to have pre-measured doses can be prepared so that the user of the these compositions do not have to measure the appropriate amount of surfactant composition to use every time they wish to clean hard surfaces, as well as laundry and dish surfaces.

The present composition is especially suitable for use in a water-soluble container where the container is simply added to a large quantity of water and dissolves, releasing its contents. The favorable dissolution and dispersion properties of the composition of the present invention are particularly useful in this context.

Thus the present invention also provides a water-soluble container containing a composition as defined above. The water-soluble container is also suitable for laundry and automatic dishwasher compositions and use.

The water-soluble container may comprise a thermoformed or injection molded water-soluble polymer. It may also simply comprise a water-soluble film. Such containers are described, for example, in EP-A-524,721, GB-A-2,244,258, WO 92/17,381 and WO 00/55,068.

The method of thermoforming the container is similar to the process described in WO 92/17382. A first poly (vinyl alcohol) ("PVOH") film is initially thermoformed to produce a non-planar sheet containing a pocket, such as a recess, which is able to retain the aqueous composition. The pocket is generally bounded by a flange, which is preferably substantially planar. The pocket may have internal barrier layers as described in, for example, WO 93/08095. The pocket is then filled with the aqueous composition, and a second PVOH film is placed on the flange and across the pocket. The second PVOH film may or may not be thermoformed. If the first film contains more than one pocket, the second film may be placed across all of the pockets for convenience. The pocket may be completely filled, or only partly filled, for example to leave an air space of from 2 to 20%, especially from 5 to 10%, of the volume of the container immediately after it is formed. Partial filling may reduce the risk of rupture of the container if it is subjected to shock and reduce the risk of leakage if the container is subjected to high temperatures.

The films are then sealed together, for example by heat sealing across the flange. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

For injection molding the containers of the present invention, the container or capsule generally comprises a receptacle part which holds the composition and a closure part, which may simply close the receptacle part or may itself have at least some receptacle function. The receptacle part preferably has side walls which terminate at their upper end in an outward flange in which the closure part is sealingly secured, especially if the closure part is in the form of a film. The securement may be by means of an adhesive but is preferably achieved by means of a seal, between the flange and the closure part. Heat sealing may be used or other methods such as infra-red, radio frequency, ultrasonic, laser, solvent, vibration or spin welding. An adhesive such as an aqueous solution of PVOH or a cellulose ether may also be used. The seal is desirably also water-soluble.

The closure part may itself be injection molded or blow molded. Preferably, however, it is a plastic film secured over the receptacle part. The film may, for example, comprise PVOH or a cellulose ether such as HPMC or another water-soluble polymer.

The container walls have thicknesses such that the containers are rigid. For example, the outside walls and any inside walls which have been injection molded independently generally have a thickness of greater than 100 μm, for example greater than 150 μm or greater than 200 μm, 300 μm or 500 μm. Preferably, the closure part is of a thinner material than the receptacle part. Thus, typically, the closure part is of thickness in the range 10 to 200 μm, preferably 50 to 100 μm, and the wall thickness of the receptacle part is in the range 300 to 1500 μm, preferably 500 to 1000 μm. The closure part may, however, also have a wall thickness of 300 to 1500 μm, such as 500 to 1000 μm.

Preferably, the closure part dissolves in water (at least to the extent of allowing the washing composition in the receptacle part to be dissolved by the water; and preferably completely) at 20° C. in less than 3 minutes, preferably in less than 1 minute.

The receptacle part and the closure part could be of the same thickness but in this event the closure part may, for example, be of higher solubility than the receptacle part, in order to dissolve more quickly.

In the manufacturing method, the array, formed by injection molding, is fed to a filling zone, and all the receptacle parts are charged with the washing composition. A sheet of a water-soluble polymer such as PVOH or a cellulose ether may then be secured over the top of the array, to form the closure parts for all the receptacle parts of the array. The array may then be split up into the individual washing capsules, prior to packaging, or it may be left as an array, for packaging, to be split by the user. Preferably, it is left as an array, for the user to break or tear off the individual washing capsules. Preferably, the array has a line of symmetry extending between capsules, and the two halves of the array are folded together, about that line of symmetry, so that closure parts are in face-to-face contact. This helps to protect the closure parts from any damage, between factory and user. It will be appreciated that the closure parts are more prone to damage than the receptacle parts. Alternatively two identical arrays of washing capsules may be placed together with their closure parts in face-to-face contact, for packaging.

In all cases, the polymer is formed into a container or receptacle such as a pouch which can receive the composition, which is filled with the composition and then sealed, for example by heat sealing along the top of the container in vertical form-fill-processes or by laying a further sheet of water-soluble polymer or molded polymer on top of the container and sealing it to the body of the container, for example by heat sealing. Other methods of sealing the films together may be used, for example infra-red, radio frequency, ultrasonic, laser, solvent, vibration or spin welding. An adhesive such as an aqueous solution of PVOH may also be used. The seal desirably is also water-soluble.

Desirably the water-soluble polymer is PVOH. The PVOH may be partially or fully alcoholized or hydrolyzed. For example, it may be from 40 to 100% preferably 70 to 92%, more preferably about 88%, alcoholized or hydrolyzed, polyvinyl acetate. When the polymer is in film form, the film may be cast, blown or extruded.

The water-soluble polymer is generally cold water (20° C.) soluble, but depending on its chemical nature, for example the degree of hydrolysis of the PVOH, may be insoluble in cold water at 20° C., and only become soluble in warm water or hot water having a temperature of, for example, 30° C., 40° C., 50° C. or even 60° C. It is preferable that the water soluble polymer is soluble in cold water.

Another useful and preferred material which can be used to encapsulate the powder compositions of the present invention is a nonwoven polyvinyl alcohol fabric available from BBA Nonwovens of South Carolina. Sachets made from this material are optimally used in warm (e.g., 40° C.) water.

The water soluble containers of the present invention find particular use where a unit-dosage form of the composition is required which is then diluted prior to use. Thus, for example, the composition may be useful as a hard surface cleaner (for example, floors, bathroom surfaces, windows) which is diluted prior to use. The water soluble container to be used for hard surface cleaners can take any shape, such as an envelope, sachet, sphere, cylinder, cube or cuboid (i.e. a rectangular parallelepiped whose faces are not all equal) where the base is square, circular, triangular, or oval, but water soluble containers of rounded cuboid or cylindrical shape are preferred; rounded cuboid for use in, for example, a bucket of water and cylindrical when used as a refill for a trigger bottle. For the rounded cuboid water soluble container, the water soluble container can have dimensions such as, for example, having a length of 1 to 5 cm, especially 3.5 to 4.5 cm, a width of 1.5 to 3.5 cm, especially 2 to 3 cm, and a height of 1 to 2 cm, especially 1.25 to 1.75 cm. The water soluble container may hold, for example, from 10 to 40 grams of the composition, especially from 15 to 25 grams of the composition of the present composition. For the cylindrical shape, the water soluble container diameter should be such that the water soluble container fits through the opening of a trigger bottle, generally about 2 cm. The length of the water soluble container can be about 1 to 8 cm. Such water soluble containers hold about 3 to about 25 grams of composition. However, it should be understood that there is no theoretical limitation, in either size or shape, and what is suitable will normally be decided upon the basis of the "dose" of the water soluble container's contents, the size of any aperture the water soluble container may have to pass through, and the available means of delivery.

In some embodiments, a single layer film for both the top and bottom the packet can be used or a laminate film of two or more layers of PVOH or other water soluble film can be used on either the top or bottom or on both top and bottom of the packet. For the cylindrical container, the film can also be single layer or a laminate of two or more layers of PVOH or other water soluble film.

SUMMARY OF THE INVENTION

The present invention relates to a composition comprising in powder form:

(a) at least one cationic surfactant having germicidal properties;

(b) at least one non-ionic;

(c) an organic acid selected from the group consisting of citric acid, lactic acid, adipic acid, succinic acid, and mixtures thereof;

(d) an alkali salt selected from the group consisting of carbonates, bicarbonates, sulfates, and mixtures thereof;

(e) optionally, up to about 10% wt. of one or more conventional additives selected from coloring agents and dyes, fragrances and fragrance solubilizers, pH adjusting agents and pH buffers including organic and inorganic salts, optical brighteners, driers, opacifying agents, antifoaming agents, enzymes, anti-spotting agents, anti-oxidants, and anti-corrosion agents.

Preferably, (a) at least one cationic surfactant having germicidal properties is present in an amount of from about 1 to 10 percent by weight; (b) at least one non-ionic surfactant is present in an amount of from about 2 to 20 percent by weight; (c) an organic acid is present in an amount of from about 0 to about 25 percent by weight; and (d) alkali salt is present in an amount of from about 45 to about 90 percent by weight.

With regard to (a) at least one cationic surfactant having germicidal properties preferably has the formula

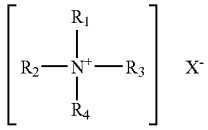

wherein each of $R_1$, $R_2$, $R_3$ and $R_4$ are independently alkyl, aryl or alkylaryl substituent of from 1 to 26 carbon atoms, in which each $R_1$, $R_2$, $R_3$ and $R_4$ is unsubstituted or substituted by one or more hydroxy, halogen, carboxyl, or alkylamido groups, and may include one or more amide, ether or ester linkages; and X may be any salt-forming anion. More preferably, (a) at least one cationic surfactant has the formula

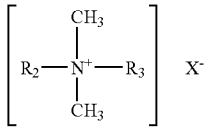

wherein $R_2$ and $R_3$ are the same or different $C_1$-$C_{12}$ alkyl, or $R_2$ is $C_{12-16}$ alkyl, $C_{8-18}$alkylethoxy, $C_{8-18}$alkylphenoxyethoxy and $R_3$ is benzyl, the alkyl and benzyl groups being unsubstituted or substituted by one or more hydroxy, halogen, carboxyl, or alkylamido groups.

Preferably, (d) alkali salt is either sodium carbonate, a mixture of sodium carbonate and sodium bicarbonate, or a mixture of sodium sulfate and sodium carbonate.

Preferably, (b) at least one non-ionic surfactant is a primary alcohol having from about 9 to about 18 carbon atoms condensed with from about 2 to about 80 moles of ethylene oxide.

In addition, it is preferred that (c) an organic acid is citric acid.

The present invention also relates to a water soluble container containing a composition of the present invention. Preferably, the containers comprise a thermoformed or injection molded water soluble polymer, which can be PVOH.

DETAILED DESCRIPTION OF THE INVENTION

The present invention relates to a composition comprising in powder form:

(a) at least one cationic surfactant having germicidal properties;

(b) at least one non-ionic;

(c) an organic acid selected from the group consisting of citric acid, lactic acid, adipic acid, succinic acid, and mixtures thereof;

(d) an alkali salt selected from the group consisting of carbonates, bicarbonates, sulfates, and mixtures thereof;

(e) optionally, up to about 10% wt. of one or more conventional additives selected from coloring agents and dyes, fragrances and fragrance solubilizers, pH adjusting agents and pH buffers including organic and inorganic salts, optical brighteners, driers, opacifying agents, antifoaming agents, enzymes, anti-spotting agents, anti-oxidants, and anti-corrosion agents.

Preferably, (a) at least one cationic surfactant having germicidal properties is present in an amount of from about 1 to 10 percent by weight; (b) at least one non-ionic surfactant is present in an amount of from about 2 to 20 percent by weight; (c) an organic acid is present in an amount of from about 0 to about 25 percent by weight; and (d) alkali salt is present in an amount of from about 45 to about 90 percent by weight.

With regard to (a) at least one cationic surfactant having germicidal properties preferably has the formula

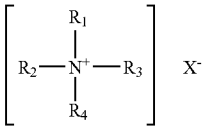

wherein each of $R_1$, $R_2$, $R_3$ and $R_4$ are independently alkyl, aryl or alkylaryl substituent of from 1 to 26 carbon atoms, in which each $R_1$, $R_2$, $R_3$ and $R_4$ is unsubstituted or substituted by one or more hydroxy, halogen, carboxyl, or alkylamido groups, and may include one or more amide, ether or ester linkages.; and X may be any salt-forming anion. More preferably, (a) at least one cationic surfactant has the formula

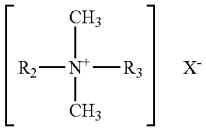

wherein $R_2$ and $R_3$ are the same or different $C_1$-$C_{12}$ alkyl, or $R_2$ is $C_{12-16}$ alkyl, $C_{8-18}$alkylethoxy, $C_{8-18}$alkylphenoxyethoxy and $R_3$ is benzyl, the alkyl and benzyl groups being unsubstituted or substituted by one or more hydroxy, halogen, carboxyl, or alkylamido groups.

Preferably, (d) alkali salt is either sodium carbonate, a mixture of sodium carbonate and sodium bicarbonate, or a mixture of sodium sulfate and sodium carbonate.

Preferably, (b) at least one non-ionic surfactant is a primary alcohol having from about 9 to about 18 carbon atoms condensed with from about 2 to about 80 moles of ethylene oxide. In addition, it is preferred that (c) an organic acid is citric acid.

The present invention also relates to a water soluble container containing a composition of the present invention. Preferably, the containers comprise a thermoformed or injection molded water soluble polymer, which can be PVOH.

The inventive compositions necessarily include at least one cationic surfactant having germicidal properties which provides a primary sanitizing benefit to the compositions.

Particularly preferred for use as the cationic surfactant which is found to provide a broad antibacterial or sanitizing function are well known, and useful cationic surfactants may be one or more of those described in, for example, *McCutcheon's Detergents and Emulsifiers*, North American and International Editions, 2001; *Kirk-Othmer, Encyclopedia of Chemical Technology,* 4th Ed., Vol. 23, pp. 478-541, the contents of which are herein incorporated by reference.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

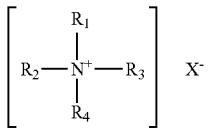

Wherein each of $R_1$, $R_2$, $R_3$ and $R_4$ are independently alkyl, aryl or alkylaryl substituent of from 1 to 26 carbon atoms, and the entire cation portion of the molecule has a molecular weight of at least 165. The alkyl substituents may be long-chain alkyl, long-chain alkoxyaryl, long-chain alkylaryl, long-chain alkylphenoxyalkyl, arylalkyl, etc. The remaining substituents on the nitrogen atoms other than the above mentioned alkyl substituents are hydrocarbons usually containing no more than 12 carbon atoms. The substituents $R_1$, $R_2$, $R_3$ and $R_4$ may be straight-chained or may be branched, but are preferably straight-chained, may be unsubstituted or substituted by one or more hydroxy, halogen, carboxyl, or alkylamido groups, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylphenyltrimethyl ammonium chloride, chlorinated dodecylbenzyltrimethyl ammonium chloride, and the like.

Preferred quaternary ammonium compounds which act as germicides and which are found to be useful in the practice of the present invention include those which have the structural formula:

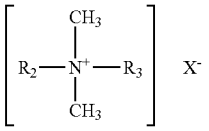

wherein $R_2$ and $R_3$ are the same or different $C_1$-$C_{12}$ alkyl, or $R_2$ is $C_{12-16}$ alkyl, $C_{8-18}$alkylethoxy, $C_{8-18}$alkylphenoxyethoxy and $R_3$ is benzyl, and X is a halide, for example chloride, bromide or iodide, or is a methosulfate or saccharinate anion. The alkyl groups recited in $R_2$ and $R_3$ may be straight-chained or branched, but are preferably substantially linear. The alkyl groups may also be unsubstituted or substituted by one or more hydroxy, halogen, carboxyl, or alkylamido groups.

Particularly useful quaternary germicides include compositions which include a single quaternary compound, as well as mixtures of two or more different quaternary compounds. Such useful quaternary compounds are available under the BARDAC®, BARQUAT®, HYAMINE®, CATIGENE, LONZABAC®, BTC®, and ONYXIDE® trademarks, which are more fully described in, for example, *McCutcheon's Functional Materials*, North American and International Editions, 2001, and the respective product literature from the suppliers identified below. For example, BARDAC® 205M is described to be a liquid containing alkyl dimethyl benzyl ammonium chloride, octyl decyl dimethyl ammonium chloride; didecyl dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/didecyl dimethyl ammonium chloride, and dioctyl dimethyl ammonium chloride (50% active) (also available as 80% active (BARDAC® 2080)); BARDAC® 2250 is described to be didecyl dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT® 4280Z (each 80% active) are each described as alkyl dimethyl benzyl ammonium chloride/alkyl dimethyl ethyl benzyl ammonium chloride; and BARQUAT® MS-100 described as being a mixture of tetradecyl dimethyl benzyl ammonium chloride/dodecyl dimethyl benzyl ammonium chloride/hexadecyl dimethyl benzyl ammonium chloride (100% solid (powder)). Also, HYAMINE® 1622, described as diisobutyl phenoxy ethoxy ethyl dimethyl benzyl ammonium chloride (available either as 100% actives or as a 50% actives solution); HYAMINE® 3500 (50% actives), described as alkyl dimethyl benzyl ammonium chloride (also available as 80% active (HYAMINE® 3500-80); and HYAMINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as didecyl dimethyl ammonium chloride (50% active); BTC® 776 is described to be myristalkonium chloride (50% active); BTC® 818 is described as being octyl decyl dimethyl ammonium chloride, didecyl dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as didecyl dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125-80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). CATIGENE series is described as mixtures of alkyl dimethyl benzyl ammonium chlorides/alkyl dimethyl ethyl benzyl ammonium chlorides/dialkyl dimethyl ammonium chlorides. (BTC®, ONYXIDE®, and CATIGENE are presently commercially available from Stepan Company, Northfield, Ill. (CATIGENE from Stepan Europe)). Polymeric quaternary ammonium salts based on these monomeric structures are also considered desirable for the present invention. One example is POLYQUAT®, described as being a 2-butenyldimethyl ammonium chloride polymer.

The cationic surfactant having germicidal properties may be present in the inventive compositions at any effective amount, but generally ranges from about 1 to about 40 percent by weight. Preferred amounts are shown in the examples below.

A further constituent in the compositions of the present invention is non-ionic surfactant. Examples include linear alcohol ethoxylates. The linear alcohol ethoxylates which may be employed in the present invention are generally the $C_6$-$C_{18}$ straight-chain alcohols which are ethoxylated with from about 2 to about 80 moles of ethylene oxide. Their derivation is well known in the art. Examples include Alfonic® 810-4.5, which is described in product literature from Condea Vista as having an average molecular weight of 356, an ethylene oxide content of about 4.85 moles (about 60 wt. %), and an HLB of about 12; Alfonic® 810-2, which is described in product literature from Condea Vista as having an average molecular weight of 242, an ethylene oxide content of about 2.1 moles (about 40 wt. %), and an HLB of about 12; and Alfonic® 610-3.5, which is described in product literature from Condea Vista as having an average molecular weight of 276, an ethylene oxide content of about 3.1 moles (about 50 wt. %), and an HLB of 10. Product literature from Condea Vista also identifies that the numbers in the alcohol ethoxylate name designate the carbon chain length (numbers before the hyphen) and the average moles of ethylene oxide (numbers after the hyphen) in the product.

Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol 91-2.5, Neodol 91-6, and Neodol 91-8. Neodol 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Additional examples include Lutensol AT80, Lutensol AT50, and Lutensol AT25, which are respectively $C_{16-18}$ alcohol ethoxylates with 80, 50, and 25 moles of ethylene oxide.

Further examples of ethoxylated alcohols include the Rhodasurf® DA series non-ionic surfactants available from Rhodia which are described to be branched isodecyl alcohol ethoxylates. Rhodasurf DA-530 has been described as having 4 moles of ethoxylation and an HLB of 10.5; Rhodasurf DA-630 has been described as having 6 moles of ethoxylation with an HLB of 12.5; and Rhodasurf DA-639 is a 90% solution of DA-630.

The compositions of the present invention also includes an organic acid. The organic acid is selected from the group consisting of citric acid, lactic acid, adipic acid, succinic acid, and mixtures thereof.

The compositions of the present invention also include an alkali salt selected from the group consisting of carbonates, bicarbonates, sulfates, and mixtures thereof. The alkali is preferably sodium. Sodium carbonate, sodium bicarbonate, and sodium sulfate are preferred. For sodium carbonate, there are a variety of grades available. Those grades having a more granular texture are preferred if liquid ingredients (for example, some cationic surfactants) are used as the materials are absorbed onto the surface of the sodium carbonate.

Other conventional optional additives, although not particularly elucidated herein may also be included in the present inventive compositions in order to provide esthetic or other beneficial properties thereto. Exemplary optional conventional additives include but are not limited to: coloring agents and dyes, fragrances and fragrance solubilizers, pH adjusting agents and pH buffers including organic and inorganic salts, optical brighteners, driers, opacifying agents, antifoaming agents, enzymes, anti-spotting agents, anti-oxidants, and anti-corrosion agents as well as others not specifically elucidated here. These should be present in minor amounts, preferably in total comprise less than about 10% by weight of the compositions. The optional ingredients chosen should be compatible with the compositions to which they are added as well as to the water soluble containers in which the compositions are placed and the compatibility can be easily determined by one of ordinary skill in the art.

Depending upon certain materials used in the composition, it may be necessary to take steps to ensure the liquid does not attack the water-soluble polymer if it is soluble in cold water (20° C.), or water at a temperature of up to, say, 35° C. Steps may be taken to treat the inside surfaces of the container, for example by coating it with agents such as for example PTFE (polytetrafluoroethylene), or to adapt the composition to ensure that it does not dissolve the polymer. For example, it has been found that ensuring the composition has a high ionic strength or contains an agent which minimizes water loss through the walls of the container will prevent the composition from dissolving the polymer from the inside. This is described in more detail in EP-A-518,689 and WO 97/27743.

The compositions according to the invention are useful in the disinfecting and/or cleaning of surfaces, especially hard surfaces in need of such treatment. These in particular include surfaces wherein the presence of gram positive and/or gram negative bacteria are suspected. In accordance with the present inventive process, cleaning and/or disinfecting of such surfaces comprises the steps of placing one or more water soluble containers which contains a composition of the present invention into a container containing an amount of water (for example, a bucket, spray bottle with dip tube) and allowing the container to dissolve, and then applying a stain releasing and a disinfecting effective amount of a composition as taught herein, by sponging, mopping, scrubbing, or spraying, to such a stained surface. Afterwards, the compositions are optionally but desirably wiped, scrubbed or otherwise physically contacted with the hard surface, and further optionally, may be subsequently rinsed from such a cleaned and disinfected hard surface.

Such a hard surface cleaning and disinfecting composition according to the invention is may be provided as a ready to use product which may be directly applied to a hard surface, but is desirably provided in a concentrated form intended to be diluted in water to form a cleaning composition therefrom.

By way of example, hard surfaces include surfaces composed of refractory materials such as: glazed and unglazed tile, porcelain, ceramics as well as stone including marble, granite, and other stones surfaces; glass; metals; plastics e.g. polyester, vinyl; fiberglass, Formica®, Corian® and other hard surfaces known to the industry. Hard surfaces which are to be particularly denoted are lavatory fixtures such as shower stalls, bathtubs and bathing appliances (racks, shower doors, shower bars) toilets, bidets, wall and flooring surfaces especially those which include refractory materials and the like. Further hard surfaces which are to be denoted are those associated with kitchen environments and other environments associated with food preparation, including cabinets and countertop surfaces as well as walls and floor surfaces especially those which include refractory materials, plastics, Formica®, Corian® and stone.

In general, it is preferred that the pH of the powder composition, when diluted in water, is greater than 7 and more preferably greater than 9. For the compositions of the present invention, acceptable disinfection is achieved when 15 grams of the compositions, whether in a water soluble container or not, is diluted in 3 liters of water; acceptable cleaning is achieved when 15 grams of the composition is diluted in 5 liters of water. A typical dissolution time, when the compositions is placed within a water soluble container, is preferably less than 2 minutes, more preferably less than 1 minute and is most preferred to be between 30 to 45 seconds.

EXAMPLE FORMULATIONS

Preparation of Example Formulations

Exemplary formulations illustrating certain preferred embodiments of the inventive compositions and described in more detail in Table 1 below were formulated generally in accordance with the following protocol. The indicated weight percentages are "as supplied" with the percent actives shown in parenthesis.

Into a suitably sized vessel, a measured amount of water was provided after which the constituents were added in no specific or uniform sequence, which indicated that the order of addition of the constituents was not critical. All of the constituents were supplied at room temperature, and any remaining amount of water was added thereafter. Certain of the nonionic surfactants if gels at room temperature were first preheated to render them pourable liquids prior to addition and mixing. Mixing of the constituents was achieved by the use of a mechanical stirrer with a small diameter propeller at the end of its rotating shaft. Mixing, which generally lasted from 5 minutes to 120 minutes was maintained until the particular exemplary formulation appeared to be homogeneous. The exemplary compositions were readily pourable, and retained well mixed characteristics (i.e., stable mixtures) upon standing for extend periods.

Another preferred way of preparing the compositions of the present invention is to first blend together non-aqueous components (for example, alcohol ethoxylates, polyethylene glycol, fragrance, and the like). A second blend of aqueous components (for example, quaternary ammonium compounds, dye, additional water (if desired) is then made. The second aqueous blend is then added to the first non-aqueous blend slowly with agitation until a homogenous blend is achieved.

A preferred way of preparing the compositions of the present invention is to first place the sodium carbonate into a vessel and add any liquid components (for example, Praepagen HY and fragrance) and form a premix. The premix is then spray dried into powder form. The resulting powder is then added to the other powder components. The dye is the last component to be added.

The compositions of the example formulations are listed on Table 1.

TABLE 1

| Component | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| Barquat MS 100 | 6.00 | 6.00 | 6.00 | 6.00 | 6.00 | 6.00 | 6.00 | 6.00 | 6.00 | 6.00 |
| Sodium carbonate light density | 60.00 | 8.25 | 20.25 | 60.00 | 60.00 | 60.00 | 60.00 | 54.88 | 60.00 | 60.00 |
| Sodium bicarbonate | | 50.00 | 50.00 | | | | | | | |
| Citric acid coated | 20.00 | 21.75 | 21.75 | 20.00 | 20.00 | 20.00 | 20.00 | 24.88 | 20.00 | 20.00 |
| Neodol 91-6 | 14.00 | 14.00 | | 14.00 | 7.00 | | | 14.00 | 7.00 | 9.80 |
| Neodol 91-8 | | | | | | 4.20 | 9.80 | | 7.00 | |
| Neodol 91-25 | | | | | 7.00 | 9.80 | 4.20 | | | 4.20 |
| Fragrance | | | | | | | | 0.25 | | |
| PE 6800 | | | 2.00 | | | | | | | |
| Speckles | | | | | | | | | | |
| TOTAL | 100.00 | 100.00 | 100.00 | 100.00 | 100.00 | 100.00 | 100.00 | 100.00 | 100.00 | 100.00 |

| Component | Ex. 11 | Ex. 12 | Ex. 13 | Ex. 14 | Ex. 15 | Ex. 16 | Ex. 17 | Ex. 18 | Ex. 19 | Ex. 20 |
|---|---|---|---|---|---|---|---|---|---|---|
| Barquat MS 100 | 3.00 | 6.00 | 6.00 | 6.00 | 6.00 | 6.00 | 6.00 | 6.00 | 6.00 | 6.00 |
| Sodium carbonate light density | 28.97 | 85.75 | 53.93 | 53.68 | 58.49 | 63.33 | 68.12 | 72.94 | 77.75 | 81.75 |
| Citric acid coated | 12.03 | | 24.07 | 24.07 | 19.26 | 14.42 | 9.63 | 4.81 | | |
| Neodol 91-6 | 5.00 | 6.00 | 14.00 | 14.00 | 14.00 | 14.00 | 14.00 | 14.00 | 14.00 | 14.00 |
| Fragrance | 0.20 | 0.40 | 0.40 | 0.40 | 0.40 | 0.40 | 0.40 | 0.40 | 0.40 | 0.40 |
| Speckles | 0.80 | 1.60 | 1.60 | 1.60 | 1.60 | 1.60 | 1.60 | 1.60 | 1.60 | 1.60 |
| Hysorb | | 0.25 | | 0.25 | 0.25 | 0.25 | 0.25 | 0.25 | 0.25 | 0.25 |
| TOTAL | 50.00 | 100.00 | 100.00 | 100.00 | 100.00 | 100.00 | 100.00 | 100.00 | 50.00 | 100.00 |

| Component | Ex. 21 | Ex. 22 | Ex. 23 | Ex. 24 | Ex. 25 | Ex. 26 | Ex. 27 | Ex. 28 | Ex. 29 | Ex. 30 |
|---|---|---|---|---|---|---|---|---|---|---|
| Barquat MS 100 | 6.00 | 6.00 | 6.00 | 6.00 | 6.00 | 6.00 | 6.00 | 6.00 | 6.00 | 6.00 |
| Sodium carbonate light density | | 30.84 | 42.88 | 61.93 | 61.93 | 61.93 | 61.93 | 31.00 | 27.00 | 20.00 |
| Sodium carbonate absorptaplus | 85.75 | 30.84 | 42.87 | | | | | | | 7.00 |
| Sodium sulfate | | | | | | | | 43.00 | 50.00 | 47.00 |
| Citric acid coated | | 24.07 | | 24.07 | 24.07 | 24.07 | | 12.00 | 9.00 | 12.00 |
| Adipic acid | | | | | | | 24.07 | | | |
| Neodol 91-6 | 6.00 | 6.00 | 6.00 | 6.00 | 6.00 | 6.00 | 6.00 | 6.00 | 6.00 | 6.00 |
| Fragrance | 0.40 | 0.40 | 0.40 | 0.40 | 0.40 | 0.40 | 0.40 | 0.40 | 0.40 | 0.40 |
| Speckles | 1.60 | 1.60 | 1.60 | 1.60 | 1.60 | 1.60 | 1.60 | 1.60 | 1.60 | 1.60 |
| Hysorb | 0.25 | 0.25 | 0.25 | | | | | | | |
| Aerosil 200 | | | | | 0.25 | | | | | |
| TOTAL | 100.00 | 100.00 | 100.00 | 100.00 | 100.00 | 100.00 | 100.00 | 100.00 | 100.00 | 100.00 |

| Component | Ex. 31 | Ex. 32 | Ex. 33 | Ex. 34 | Ex. 35 | Ex. 36 | Ex. 37 | Ex. 38 | Ex. 39 | Ex. 40 |
|---|---|---|---|---|---|---|---|---|---|---|
| Barquat MS 100 | 6.00 | 6.00 | 6.00 | 6.00 | 6.00 | 6.00 | 6.00 | 6.00 | 6.00 | 6.00 |
| Sodium carbonate light density | 20.00 | 30.00 | 26.00 | 23.00 | 28.00 | 26.00 | 28.00 | 60.00 | | 83.00 |
| Sodium carbonate, dense | | | | | | | | | 85.00 | |
| Sodium carbonate, absorptaplus | 7.00 | | | | | | | | | |
| Sodium sulfate | 47.00 | 42.00 | 47.00 | 50.00 | 52.00 | 52.00 | 52.00 | | | |
| Citric acid coated | | 12.00 | 11.00 | 11.00 | 6.00 | | 6.00 | 20.00 | | |
| Adipic acid | 12.00 | | | | | 6.00 | | | | |
| Neodol 91-6 | 6.00 | 8.00 | 8.00 | 8.00 | | | 6.00 | 4.20 | 6.00 | 8.00 |

TABLE 1-continued

| | | | | | | | | | | |
|---|---|---|---|---|---|---|---|---|---|---|
| Neodol 91-8 | | | | | 6.00 | | | | | |
| Neodol 91-25 | | | | | | 8.00 | | 9.80 | | |
| Amonyx LO | | | | | | | | | | |
| Fragrance | 0.40 | 0.40 | 0.40 | 0.40 | 0.40 | 0.40 | 0.60 | | | |
| Speckles | 1.60 | 1.60 | 1.60 | 1.60 | 1.60 | 1.60 | 1.40 | | | |
| Dye | | | | | | | | | 3.00 | 3.00 |
| TOTAL | 100.00 | 100.00 | 100.00 | 100.00 | 100.00 | 100.00 | 100.00 | 100.00 | 100.00 | 100.00 |

| Component | Ex. 41 | Ex. 42 | Ex. 43 | Ex. 44 | Ex. 45 | Ex. 46 | Ex. 47 | Ex. 48 | Ex. 49 | Ex. 50 |
|---|---|---|---|---|---|---|---|---|---|---|
| Barquat MS 100 | 6.00 | 6.00 | 6.00 | 6.00 | 6.00 | 6.00 | 6.00 | 6.00 | 1.20 | 1.20 |
| Sodium carbonate light density | | | 20.80 | | | | | | | |
| Sodium carbonate, absorptaplus | | 83.00 | | | | | | | | |
| Sodium carbonate, grade 100 | 86.00 | | 62.20 | 81.00 | 79.00 | 50.00 | 78.00 | 77.85 | 80.40 | 86.40 |
| Sodium sulfate | | | | | | 29.00 | | | | |
| Karion | | | | | | | | | | |
| Sodium citrate | | | | | | | 1.00 | 1.00 | | |
| EDTA acid | | | | | | | | 0.15 | | |
| Citric acid coated | | | | | | | | | 6.00 | |
| Neodol 91-6 | 6.00 | 8.00 | 8.00 | 10.00 | 10.00 | 10.00 | 10.00 | 10.00 | 10.00 | 10.00 |
| Dye | 6.00 | 3.00 | 3.00 | 3.00 | 5.00 | 5.00 | 5.00 | 5.00 | 2.40 | 2.40 |
| TOTAL | 104.00 | 100.00 | 100.00 | 100.00 | 100.00 | 100.00 | 100.00 | 100.00 | 100.00 | 100.00 |

| Component | Ex. 51 | Ex. 52 | Ex. 53 | Ex. 54 | Ex. 55 | Ex. 56 | Ex. 57 | Ex. 58 | Ex. 59 | Ex. 60 |
|---|---|---|---|---|---|---|---|---|---|---|
| Barquat MS 100 | 1.20 | 1.20 | 1.20 | 1.20 | 1.20 | 1.20 | | 1.20 | 3.60 | 1.20 |
| Catigene T-50 | | | | | | | 4.00 | | | |
| Sodium carbonate light density | 48.10 | 56.18 | 80.40 | 75.40 | 75.40 | 45.40 | 72.60 | 70.40 | 73.96 | 76.36 |
| Citric acid coated | 6.00 | 6.00 | 6.00 | 6.00 | 6.00 | 6.00 | 6.00 | 6.00 | 6.00 | 6.00 |
| Sodium citrate | 32.30 | 24.22 | | | | 30.00 | | | | |
| Neodol 91-6 | 10.00 | 10.00 | | 15.00 | | 15.00 | 15.00 | 20.00 | 15.00 | 15.00 |
| Neodol 91-8 | | | | | 15.00 | | | | | |
| Videt QX-9 | | | 10.00 | | | | | | | |
| Dye | 2.40 | 2.40 | 2.40 | 2.40 | 2.40 | 2.40 | 2.40 | 2.40 | 1.44 | 1.44 |
| TOTAL | 100.00 | 100.00 | 100.00 | 100.00 | 100.00 | 100.00 | 100.00 | 100.00 | 100.00 | 100.00 |

| Component | Ex. 61 | Ex. 62 | Ex. 63 | Ex. 64 | Ex. 65 | Ex. 66 | Ex. 67 | Ex. 68 | Ex. 69 | Ex. 70 |
|---|---|---|---|---|---|---|---|---|---|---|
| Barquat MS 100 | 3.60 | 3.60 | 3.60 | 3.60 | 3.60 | 3.60 | 3.60 | 3.60 | 3.60 | 3.60 |
| Praepagen HY | 2.40 | 2.40 | 1.40 | 0.50 | | 2.00 | 4.00 | 4.00 | | 2.00 |
| Sodium carbonate light density | 70.60 | 73.00 | 74.00 | 74.90 | 75.40 | 77.20 | 71.40 | 75.20 | 83.00 | 81.00 |
| Citric acid coated | 6.00 | 6.00 | 6.00 | 6.00 | 6.00 | 6.00 | 6.00 | 6.00 | 6.00 | 6.00 |
| Neodol 91-6 | 15.00 | 12.60 | 12.60 | 12.60 | 12.60 | 8.80 | 12.60 | 8.80 | 5.00 | 5.00 |
| Dye | 2.40 | 2.40 | 2.40 | 2.40 | 2.40 | 2.40 | 2.40 | 2.40 | 2.40 | 2.40 |
| TOTAL | 100.00 | 100.00 | 100.00 | 100.00 | 100.00 | 100.00 | 100.00 | 100.00 | 100.00 | 100.00 |

| Component | Ex. 71 | Ex. 72 | Ex. 73 | Ex. 74 | Ex. 75 | Ex. 76 | Ex. 77 | Ex. 78 | Ex. 79 | Ex. 80 |
|---|---|---|---|---|---|---|---|---|---|---|
| Barquat MS 100 | 3.60 | 3.60 | 3.60 | 3.60 | 3.60 | 3.60 | 3.60 | 3.60 | 3.60 | 3.60 |
| Praepagen HY | 2.00 | 4.00 | | 3.75 | 3.75 | 3.75 | 3.75 | | 3.84 | 1.00 |
| Sodium carbonate light density | 73.40 | 79.00 | 79.20 | 70.05 | 76.05 | 77.65 | 77.60 | 81.35 | 77.56 | 86.00 |
| Citric acid coated | 6.00 | 6.00 | 6.00 | 6.00 | | | | | | |
| Neodol 91-6 | 12.60 | 5.00 | 8.80 | 12.60 | 12.60 | 12.60 | 12.60 | | | |
| Lutensol AT80 | | | | | | | | 12.60 | 12.60 | 7.00 |
| Speckles | | | | 2.00 | 2.00 | | | | | |
| Fragrance | 2.40 | 2.40 | 2.40 | 2.00 | 2.00 | 2.40 | 2.40 | 2.40 | 2.40 | 2.40 |
| Dye | | | | | | | 0.05 | 0.05 | | |
| TOTAL | 100.00 | 100.00 | 100.00 | 100.00 | 100.00 | 100.00 | 100.00 | 100.00 | 100.00 | 100.00 |

| Component | Ex. 81 | Ex. 82 | Ex. 83 | Ex. 84 | Ex. 85 | Ex. 86 | Ex. 87 | Ex. 88 | Ex. 89 |
|---|---|---|---|---|---|---|---|---|---|
| Barquat MS 100 | 3.60 | 3.60 | 3.60 | 3.60 | 3.60 | 3.60 | 3.60 | 3.60 | 3.60 |
| Praepagen HY | 1.00 | 1.00 | 2.00 | | | | | 2.00 | 1.36 |
| Sodium carbonate light density | 86.00 | 86.00 | 85.00 | | | | | | |
| Sodium carbonate\|100 | | | | 79.87 | 75.87 | 65.87 | 55.87 | 63.87 | 64.51 |
| Sodium Bicarbonate | | | | | | 10.00 | 20.00 | 10.00 | 10.00 |

TABLE 1-continued

| | | | | | | | | | |
|---|---|---|---|---|---|---|---|---|---|
| Citric acid coated | | | | 6.00 | 10.00 | 10.00 | 10.00 | 10.00 | 10.00 |
| Neodol 91-6 | | | | | | | | | |
| Lutensol AT80 | | | 7.00 | 10.00 | 10.00 | 10.00 | 10.00 | 10.00 | 10.00 |
| Lutensol AT50 | 7.00 | | | | | | | | |
| Lutensol AT25 | | 7.00 | | | | | | | |
| Speckles | | | | | | | | | |
| Fragrance | 2.40 | 2.40 | 2.40 | 0.50 | 0.50 | 0.50 | 0.50 | 0.50 | 0.50 |
| Dye | | | | 0.03 | 0.03 | 0.03 | 0.03 | 0.03 | 0.03 |
| TOTAL | 100.00 | 100.00 | 100.00 | 100.00 | 100.00 | 100.00 | 100.00 | 100.00 | 100.00 |

| Component | |
|---|---|
| Barquat MS 100 | N-alkyl-N,N-dimethyl-N-benzylammonium chloride (Lonza) (100%) |
| Sodium bicarbonate | Sodium bicarbonate |
| Citric acid coated | Coated citric acid |
| Neodol 91-6 | $C_9$-$C_{11}$ alcohol with avg. 6 moles of ethylene oxide per mole of alcohol (Shell) |
| Neodol 91-8 | $C_9$-$C_{11}$ alcohol with avg. 8-9 moles of ethylene oxide per mole of alcohol (Shell) |
| Neodol 91-25 | $C_9$-$C_{11}$ alcohol with avg. 2.5 moles of ethylene oxide per mole of alcohol (Shell) |
| Fragrance | Proprietary fragrance |
| PE 6800 | Copolymer surfactant |
| Speckles | Speckles |
| Hysorb | Grafted sodium polyacrylate (BASF) |
| Sodium carbonate light density | Sodium carbonate, light density |
| Sodium carbonate absorptaplus | Sodium carbonate, absorptaplus |
| Sodium sulfate | Sodium sulfate |
| Adipic acid | Adipic acid |
| Aerosil 200 | Colloidal silicon dioxide |
| Sodium carbonate, dense | Sodium carbonate, dense |
| Ammonyx LO | Dimethyldodecylamine oxide |
| Sodium carbonate, grade 100 | Sodium carbonate, grade 100 |
| Karion | Sorbitol (Merck) |
| Sodium citrate | Sodium citrate |
| EDTA acid | Ethylenediaminetetraacetic acid |
| Videt QX-9 | Non-germicidal cationic surfactant |
| Catigene T-50 | Didecyldimethyl ammonium chloride (50%) (Stepan) |
| Praepagen HY | Alkyl dimethyl hydroxyethylammonium chloride (40%) (Clariant) |
| Lutensol AT80 | $C_{16-18}$ fatty alcohol ethoxylate (80 moles EO; BASF) |
| Lutensol AT50 | $C_{16-18}$ fatty alcohol ethoxylate (50 moles EO; BASF) |
| Lutensol AT25 | $C_{16-18}$ fatty alcohol ethoxylate (25 moles EO; BASF) |

The above formulations are then placed into either thermoformed or injection molded water soluble containers using the methods described above. The water soluble containers showed no very little or no migration of liquid when stored at room temperature.

Ex. 24 was evaluated for microbiological testing using the European Union standard suspension test, European Norm 1276 (EN1276), a standard test for evaluation of the effectiveness of biocides in two ways: 15 grams of powder without PVOH film diluted in 5 liters of water and 15 grams of powder encapsulated in a PVOH film diluted in 5 liters of water. Organisms tested were *Pseudomonas aeruginosa; Esherichia coli, Staphylococcus aureus; Enteroccus hirae* for a five (5) minute contact time. Both diluted samples had a ≧5 log reduction against *Staphylococcus aureus, Esherichia coli*, and *Enteroccus hirae* but not *Pseudomonas aeruginosa.*

Ex. 89 was also evaluated using EN1276 except that at a dilution of 15 gram sample in 3 liters of water. Under these conditions, Ex. 89 diluted samples had a >5 log reduction against *Pseudomonas aeruginosa, Esherichia coli, Staphylococcus aureus*, and *Enteroccus hirae.*

Ex. 89 was evaluated for cleaning using the ASTM Vinyl Cleaning Test, ASTM D4488-89 Annex A5 for particulate soil, which evaluated the efficacy of the cleaning compositions on vinyl tile samples. The soil applied was a particulate soil sample containing natural humus, paraffin oil, used crankcase motor oil, Portland cement, silica, lampblack carbon, iron oxide, bandy black clay, stearic acid, and oleic acid. produced according to the protocol. Each of the soiled test vinyl tile samples were placed into the apparatus and the center of each tile was wetted with a 20 milliliter sample of a test formulation and allowed to stand for 1 minute. The test solution was prepared by diluting a 15 gram sachet of Ex. 89 in 5 liters of water. When approximately 30 seconds had elapsed, a further 50 milliliter sample was applied to the sponge (water dampened, then wrung to remove excess water) of a Gardner Abrasion Tester apparatus. Thereafter the apparatus was cycled 10 times, which provided 20 strokes of the sponge across the face of each of the vinyl test tiles. The reflectance values of the cleaned samples at 10 cycles were evaluated utilizing a Minolta Chroma Meter CF-110, with Data Processor DP-100, which evaluated spectrophotomic characteristics of the sample. A control of St. Marc base (Reckitt Benckiser France; no fragrance) at a usage rate of 60 milliliters in 5 liters of water was used. In both instances, the water temperature was about 40° C. The diluted Ex. 89 was found to be at parity on cleaning with the St. Marc base.

Ex. 76 was also tested using ASTM D4488-89 Annex A5 for particulate soil against the same control as Ex. 89. Ex. 89 was found to be slightly better at cleaning than the control.

The invention claimed is:

1. A water-soluble container having a single pocket or single receptacle part containing a hard surface cleaning composition in powder form, said single pocket or single receptacle part sealed by a film or closure part which comprises:

(a) at least one cationic surfactant having germicidal properties, said cationic surfactant being present in an amount of from about 1 to about 6 percent by weight;

(b) at least one non-ionic surfactant, said non-ionic surfactant being present in an amount of from about 6 to about 20 percent by weight;

(c) an organic acid selected from the group consisting of citric acid, lactic acid, adipic acid, succinic acid, and mixtures thereof, said organic acid being present in an amount up to about 25 percent by weight;

(d) an alkali salt selected from the group consisting of carbonates, bicarbonates, sulfates, and mixtures thereof, said alkali salt being present in an amount of from about 45 to about 90 percent by weight;

(e) optionally, up to about 10% wt. of one or more conventional additives selected from coloring agents, fragrances and fragrance solubilizers, pH adjusting agents and pH buffers including organic and inorganic salts, optical brighteners, opacifying agents, antifoaming agents, enzymes, anti-spotting agents, anti-oxidants, and anti-corrosion agents wherein, wherein the hard surface cleaning composition in powder form necessarily comprises coated citric acid;

when the water-soluble container is immersed in water, at least a part of the water-soluble container dissolves releasing the composition which effervesces in water, and wherein the resultant aqueous mixture formed is at a pH of greater than 7.

2. The container according to claim 1 wherein the water-soluble container comprises a thermoformed or injection molded water-soluble polymer.

3. The container according to claim 2 wherein the water-soluble polymer is poly (vinyl alcohol).

4. A process for cleaning disinfecting hard surfaces which comprises the process step of:

dissolving an effective amount of a composition according to claim 1 in water; and applying the dissolved composition to the surface.

5. The container according to claim 1 wherein the (a) at least one cationic surfactant having germicidal properties has the formula:

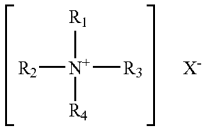

wherein each of $R_1$, $R_2$, $R_3$ and $R_4$ are independently alkyl, aryl or alkylaryl substituent of from 1 to 26 carbon atoms, in which each $R_1$, $R_2$, $R_3$ and $R_4$ is unsubstituted or substituted by one or more hydroxy, halogen, carboxyl, or alkylamido groups, and may include one or more amide, ether or ester linkages; and X may be any salt-forming anion.

6. The container according to claim 5 wherein the (a) at least one cationic surfactant has the formula

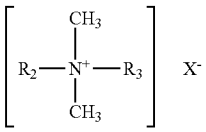

wherein $R_2$ and $R_3$ are the seine or different $C_1$-$C_{12}$ alkyl, or $R_2$ is $C_{12-16}$alkyl, $C_{8\ 18}$alkylethoxy, $C_{8-18}$alkylphenoxyethoxy and $R_3$ is benzyl, the alkyl and benzyl groups being unsubstituted or substituted by one or more hydroxy, halogen, carboxyl, or alkylamido groups.

7. The container according to claim 1 wherein the (d) alkali salt is a mixture of sodium carbonate and sodium bicarbonate.

8. The container according to claim 1 wherein the (d) alkali salt is solely sodium carbonate.

9. The container according to claim 1 wherein (d) alkali salt is a mixture of sodium sulfate and sodium carbonate.

10. The container according to claim 1 wherein the (b) at least one non-ionic surfactant is a primary alcohol having from about 9 to about 18 carbon atoms condensed with from about 2 to about 80 moles of ethylene oxide.

11. The container according to claim 1 wherein the (b) at least one non-ionic surfactant is present in an amount of from about 8 to about 20 percent by weight.

12. The container according to claim 11 wherein the (b) at least one non-ionic surfactant is present in an amount of from about 10 to about 20 percent by weight.

13. The container according to claim 12 wherein the (b) at least one non-ionic surfactant is present in an amount of from about 12 to about 20 percent by weight.

14. The container according to claim 13 wherein the (b) at least one non-ionic surfactant is present in an amount of from about 12.6 to about 20 percent by weight.

15. The container according to claim 14 wherein the (b) at least one non-ionic surfactant is present in an amount of from about 15 to about 20 percent by weight.

16. The container according to claim 1 wherein the receptacle part is a thermoformed non-planar sheet containing a pocket.

17. The container according to claim 1 wherein the container has walls such that the container is a rigid container.

18. The container according to claim 1 wherein the receptacle part of the container includes walls which have a thickness of greater than 100 μm.

19. A water-soluble container according to claim 1 consisting essentially of a container enclosing a single dose of a hard surface cleaning composition in powder form which comprises:

(a) at least one cationic surfactant having germicidal properties, said cationic surfactant being present in an amount of from about 1 to about 6 percent by weight;

(b) at least one non-ionic surfactant, said non-ionic surfactant being present in an amount of from about 6 to about 20 percent by weight;

(c) an organic acid selected from the group consisting of citric acid, lactic acid, adipic acid, succinic acid, and mixtures thereof, said organic acid being present in an amount up to about 25 percent by weight;

(d) an alkali salt selected from the group consisting of carbonates, bicarbonates, sulfates, and mixtures thereof, said alkali salt being present in an amount of from about 45 to about 90 percent by weight;

(e) optionally, up to about 10% wt. of one or more conventional additives selected from coloring agents, fragrances and fragrance solubilizers, pH adjusting agents and pH buffers including organic and inorganic salts, optical brighteners, opacifying agents, antifoaming agents, enzymes, anti-spotting agents, anti-oxidants, and anti-corrosion agents wherein, when the water-soluble container is immersed in water, at least a part of the water-soluble container dissolves releasing the composition which effervesces in water, and wherein the resultant mixture is at a pH of greater than 7 wherein the hard surface cleaning composition in powder form necessarily comprises coated citric acid.

20. A water-soluble container according to claim 1 characterized in that a 15 gram sample of the said hard surface cleaning composition in powder form contained with the water-soluble container is diluted in 5 liters of water, the resultant aqueous mixture exhibits antimicrobial efficacy against one or more of: *Pseudomonas aeruginosa, Escherichia coli, Staphylococcus aureus, Enteroccus hirae* following a 5 minute contact time.

21. A water-soluble container according to claim 20 characterized in that a 15 gram sample of the said hard surface cleaning composition in powder form contained with the water-soluble container is diluted in 5 liters of water, the resultant aqueous mixture exhibits antimicrobial efficacy against one or more of: *Pseudomonas aeruginosa, Escherichia coil, Staphylococcus aureus, Enteroccus hirae* following a 5 minute contact time.

22. A water-soluble container according to claim 20 characterized in that a 15 gram sample of the said mixture contained with the water-soluble container is diluted in 5 liters of water, the resultant aqueous mixture exhibits >5 log reduction of one or more of: *Pseudomonas aeruginosa, Escherichia coli, Staphylococcus aureus, Enteroccus hirae* following a 5 minute contact time according to European Norm 1276 (EN1276).

* * * * *